United States Patent [19]

Gilbey

[11] 4,251,473

[45] Feb. 17, 1981

[54] AERATING APPARATUS

[75] Inventor: Guy Gilbey, Empingham, United Kingdom

[73] Assignee: Sodastream Limited, Peterborough, England

[21] Appl. No.: 69,538

[22] Filed: Aug. 24, 1979

Related U.S. Application Data

[63] Continuation of Ser. No. 927,913, Jul. 25, 1978, abandoned.

[30] Foreign Application Priority Data

| | | | |
|---|---|---|---|
| Jul. 29, 1977 | [GB] | United Kingdom | 32041/77 |
| May 31, 1978 | [GB] | United Kingdom | 32041/77 |
| Feb. 2, 1978 | [GB] | United Kingdom | 04328/78 |

[51] Int. Cl.[3] ..... B01F 3/04

[52] U.S. Cl. ..... 261/51; 137/209; 222/191; 251/324; 261/121 R; 261/DIG. 7

[58] Field of Search ..... 261/44 A, 51, 59, 121 R, 261/DIG. 7, DIG. 65; 222/191, 249, 309; 99/275, 323.1; 137/209; 251/324, 325, 347; 426/474, 477

[56] References Cited

U.S. PATENT DOCUMENTS

| | | | |
|---|---|---|---|
| 1,260,594 | 3/1918 | Swan | 261/51 |
| 2,643,866 | 6/1953 | Kollsman | 222/249 X |
| 3,226,099 | 12/1965 | Black et al. | 261/DIG. 7 |
| 3,581,761 | 6/1971 | Noland | 137/209 |
| 3,953,550 | 4/1976 | Gilbey | 261/DIG. 7 |
| 3,960,164 | 6/1976 | Kelley | 261/DIG. 7 |
| 4,058,120 | 11/1977 | Caparrelli et al. | 261/DIG. 65 |

FOREIGN PATENT DOCUMENTS

| | | | |
|---|---|---|---|
| 392750 | 5/1933 | United Kingdom | 261/DIG. 7 |
| 1453363 | 10/1976 | United Kingdom | 261/DIG. 7 |

*Primary Examiner*—Richard L. Chiesa
*Attorney, Agent, or Firm*—Watson, Cole, Grindle & Watson

[57] ABSTRACT

A portable carbonating apparatus of the type comprising a pressure vessel and a header tank has a bottom inlet and a top outlet controlled by respective valve pistons which are rigidly connected together by a connecting rod.

The pistons have equal areas exposed within the pressure vessel, so as to be pressure balanced at all times.

The top valve piston also acts to control opening and closing of a venting port to ensure venting of pressure from a head space during initial opening movement of the valves.

The header tank is self-valved and is detachable from the apparatus.

4 Claims, 7 Drawing Figures

41
39
38
45
44
42
43
L
37
40
33
36
34

AERATING APPARATUS

This is a continuation, of application Ser. No. 927,913 filed July 25, 1978, and now abandoned.

This invention relates to portable apparatus for carbonating water, suitable for use for example in homes, offices, restaurants, and bars.

Apparatus of this type falls into two main categories. In the first category, a bottle containing water is mounted in the machine and water is carbonated in the bottle which is then removed from the apparatus. Apparatus of this type is described, for example, in British Patent Specification No. 145 3363 and has been widely marketed in Great Britian and elsewhere.

In the second category of apparatus, with which the present invention is concerned, the apparatus comprises a pressure vessel and a header tank, the vessel having a valved bottom inlet to admit fresh water from the header tank to the pressure vessel, a valved outlet in an upper region of the vessel for discharging carbonated water, and an injection nozzle for admitting $CO_2$ under pressure. Fresh water is carbonated within the vessel and the outlet and inlet are opened to admit fresh water from a header tank to the bottom inlet, the fresh water displacing the carbonated water upwardly in the vessel and through the outlet. This type of apparatus is described, for example, in British Patent Specification No. 392,750 and was at one time in widespread use.

The present invention is primarily concerned with improving the valving arrangements in apparatus of the second category.

In the apparatus described in U.S. Pat. No. 392,750, the inlet and outlet valve members take the form of poppet type, face sealing valves which are spring loaded against their respective valve seats. Because the valves must resist the pressure generated in the vessel during carbonation, it is necessary for the spring acting on the outlet valve to be sufficiently powerful to resist the pressure tending to blow the valve off its seating. This in turn means that a correspondingly large force must be applied to open the valve when the carbonated water is to be discharged, with the result that the apparatus may be difficult to operate by a woman or child, unless, of course, a somewhat complex mechanism is designed to provide a suitable mechanical advantage. The mechanism is in any case slightly complicated by the need to provide lost motion between the two valves, so that the outlet shall always be opened in advance of the inlet.

The primary object of the present invention is to improve the valving arrangements and overcome the above mentioned disadvantages.

The present invention accordingly provides portable apparatus for carbonating water, comprising a pressure vessel and a header tank, the vessel having a valved bottom inlet to admit fresh water from the header tank to the pressure vessel and a valved outlet in an upper region of the vessel for discharging carbonated water, and an injection nozzle for admitting $CO_2$ under pressure, and wherein the inlet and outlet valves take the form of pistons which are rigidly connected together to form a unitary plunger and have equal areas exposed within the pressure vessel, whereby the plunger is substantially pressure balanced.

By this simple expedient, the construction of the valves is simplified, the forces required to open the valves are practically eliminated, and a very simple form of operating linkage can accordingly be provided. Preferably, the plunger has an axial extension projecting from the vessel and connected to an operating lever.

A secondary, but related disadvantage of the known apparatus is that opening of the outlet valve is accompanied by an initial dribble of liquid from the outlet and an audible spitting noise, which are undesirable features of operation of the apparatus. These related phenomena arise because the headspace of the vessel contains gas under pressure which escapes suddenly when the outlet valve is first opened and carries some water with it.

This problem is also received in a simple and effective manner in accordance with a preferred feature of the invention by providing the headspace of the vessel with a venting port which is normally closed by the outlet valve, but is connected to atmosphere during an initial stage of opening movement of the outlet valve piston.

With this arrangement, the gas pressure is released without any possibility of entraining liquid from the vessel.

In order to ensure that the headspace is completely vented before the valves are open, it is preferred to guide the operating lever of the plunger in a gate, which interrupts opening movement of the lever in a position in which the venting port is open, but in which the two valves are still closed.

One form of carbonating apparatus in accordance with the invention will now be described by way of example with reference to the accompanying drawings in which.

Figure 1:
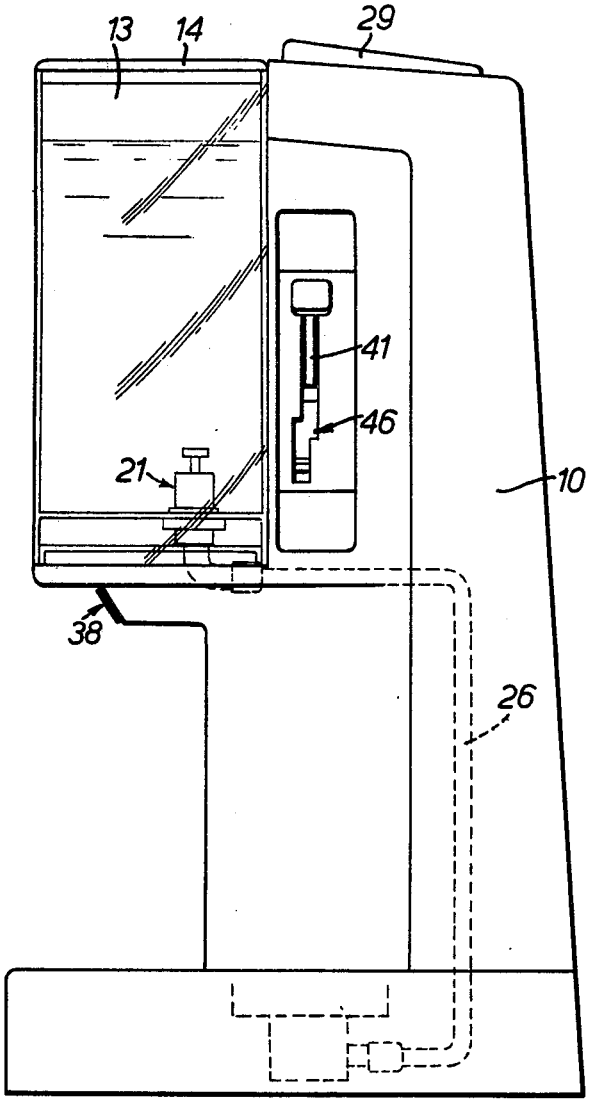
FIG. 1 is a side view of the apparatus according to the invention.

The apparatus shown in the drawings comprises a casing 10, preferably formed by moulded plastics components housing a pressure vessel 11, a replaceable $CO_2$ cylinder 12 and a removable header tank 13 for containing a quantity of fresh water.

Figure 2:
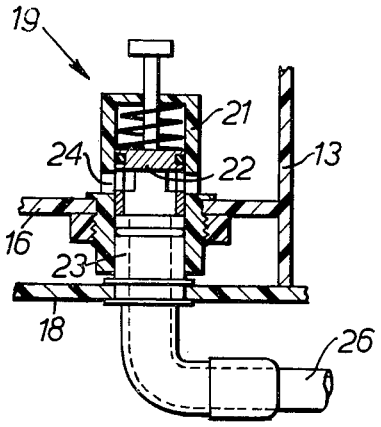
FIG. 2 is a sectional detail view of part of the FIG. 1 apparatus.
Figure 3:
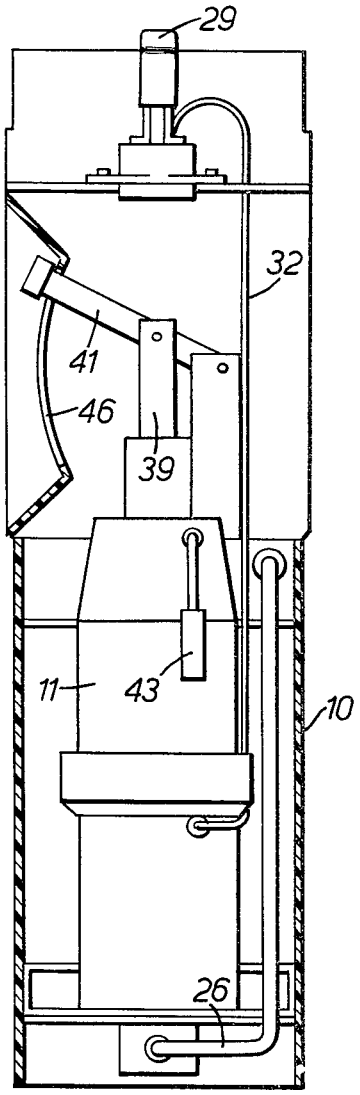
FIG. 3 is a rear view of the FIG. 1 apparatus, with the casing shown partially broken away for clarity.

The tank 13 is conveniently of transparent moulded plastics material and has a hinged lid 14 to facilitate filling of the tank. At its base, the tank has a bottom wall 16 and a depending peripheral skirt 17 by which the tank locates on a horizontal platform 18 of the casing. The tank has a self-closing outlet valve 19, best seen in the enlarged section of FIG. 2, the valve comprising a housing 21 in which is guided a spring loaded valve plunger 22, which in the operating position of the tank is held up in an open position by its engagement with a hollow nipple 23 mounted on the platform 18. In this condition, the interior of the tank communicates, through side openings 24 in housing 21, with the housing and the interior of nipple 23 and thus with a water feed tube 26, in turn connected to the pressure vessel as explained in detail below.

The tank makes snap fitting engagement with the platform 18 and may be removed by pulling it upwardly, whereupon the plunger 22 descends under its spring loading to close off the outlet. It is not necessary for the user to remove the tank in order to refill it, but it is possible for the user to keep several spare tanks full of water chilling in a refrigerator in order to be able to dispense chilled drinks when desired.

The $CO_2$ cylinder 12 used with the apparatus is of standardised form, having a screw threaded nipple 27, which is screwed into a boss 28 mounted on the casing. The boss also supports a gas-valve actuating lever 29 which acts through a sealed plunger 30 on the valve in the cylinder and has an outlet 31 for $CO_2$ connected to a gas supply tube 32 leading to an injection lance 33 fitted in the side wall of the pressure vessel 11. Gas is released through the lance into the vessel simply by manual depression of the actuating lever 29, in known manner.

Turning now to the pressure vessel 11, this is conveniently formed by a pair of mouldings screw threaded to each other about the waist of the vessel with a pressure seal interposed.

Figure 4:
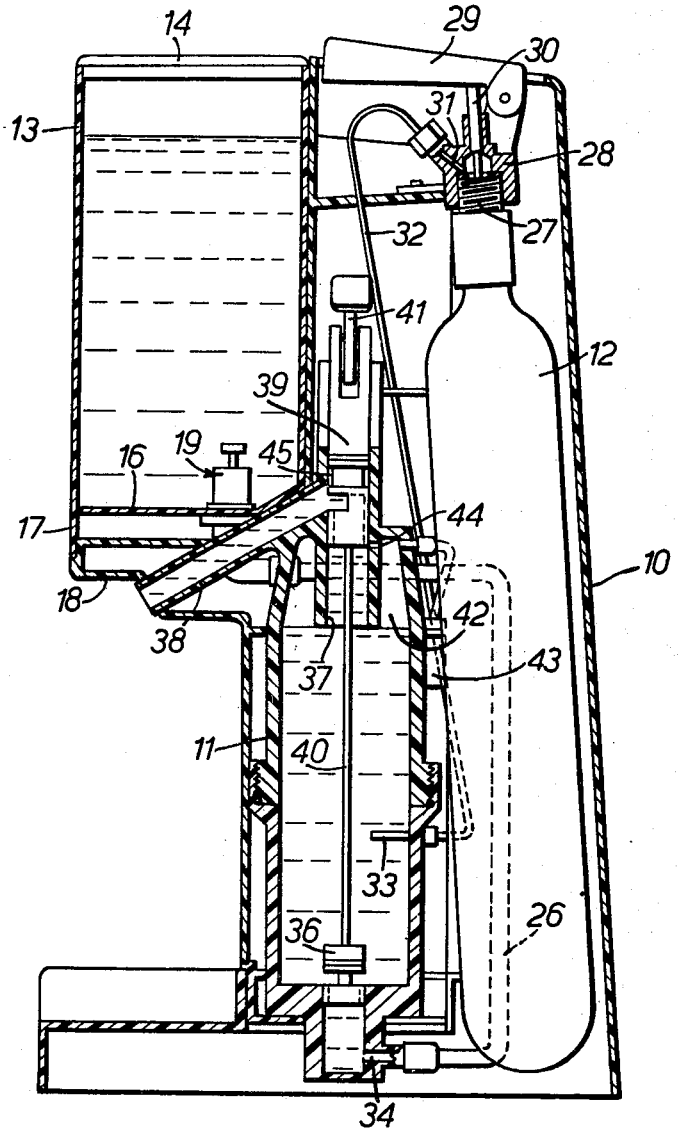
FIG. 4 is a sectional elevational view.

The vessel (see FIG. 5) has a bottom inlet 34 connected to the water feed tube 26. Opening and closing of the inlet is controlled by an inlet valve piston 36, the lower portion of which is formed as a hollow skirt which is slotted in its upper region, so that in the raised position of the piston seen in FIG. 4, the bottom inlet is open to the interior of the vessel. The outlet at the upper end of the vessel comprises an axial valve bore 37 leading upwardly to an outlet spout 38. The outlet valve comprises a sealed valve piston 39, having a neck 45 and a lower portion formed as a hollow skirt having a slot in its upper region, so that in the raised position shown in FIG. 4, the interior of the vessel is in open communication with the outlet spout 38. The two valve pistons are rigidly connected together for movement in unison by a connecting rod 40, so as to form a unitary plunger, which is extended axially upwardly, projecting from the vessel for connection to an operating lever 41, operation of which is described below.

The two pistons are of equal sealed diameter so that in the closed condition of the valves, there are no unbalanced pressure forces acting axially on the unitary plunger.

The vessel 11 is, as is conventional, provided with a headspace 42 in which excess gas under pressure can accumulate. The head space is connected in known manner to a pressure relief valve 43 and at its upper end has a venting port 44 leading to the valve bore 37 at a level below the entrance to the discharge spout 38, to permit relief of the head space pressure in the manner described below.

Figures 5, 6, 7:
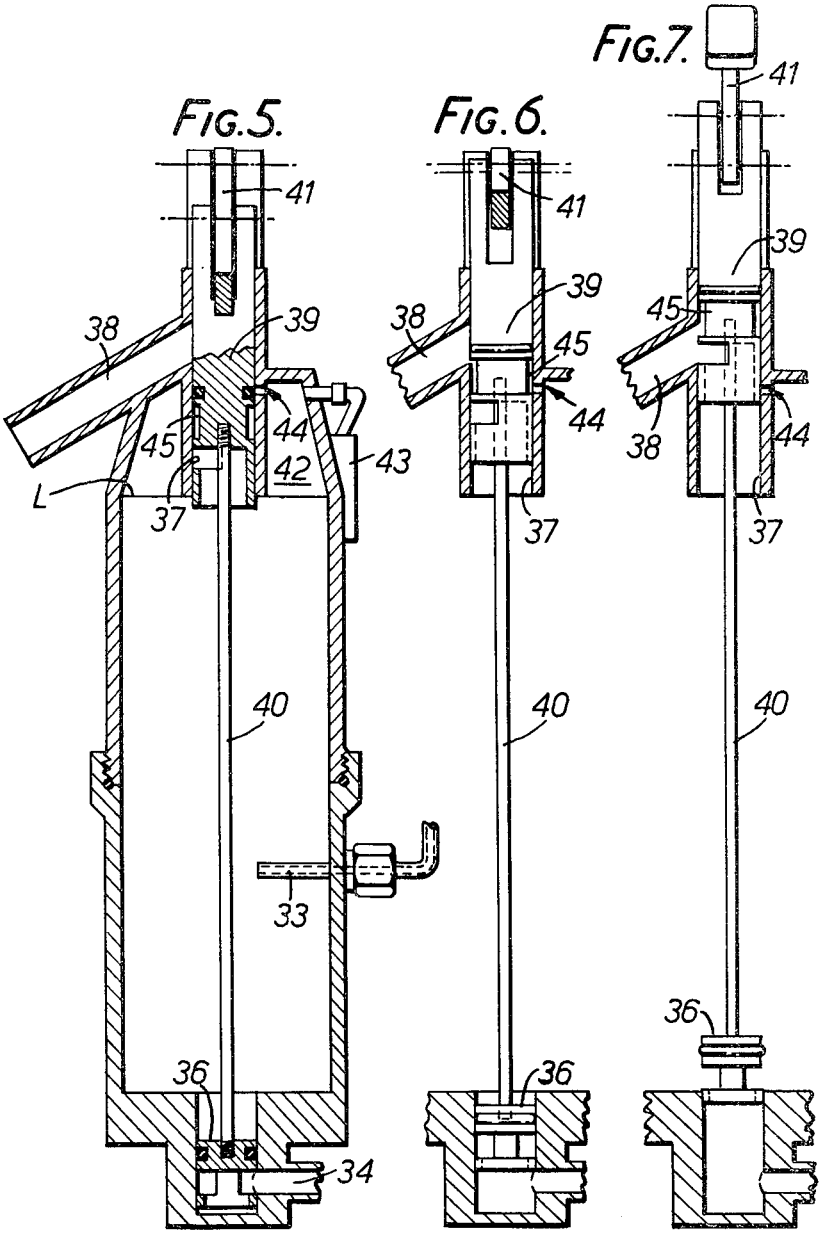
FIGS. 5, 6 and 7 are sectional elevations corresponding with FIG. 4, illustrating the operation of the apparatus.

The operating sequence will now be described starting from the rest position shown in FIG. 5, in which the pressure vessel contains liquid, usually fresh water, up to the level L indicated, that is up to the lower level of the head space 42. The lever 29 is depressed to inject pressurised $CO_2$ into the water. Some gas is dissolved and free gas collects in the head space 42 until the pressure relief valve 43 blows off audibly, indicating to the user that the gas discharge valve should be released. Discharge of the aerated water is then effected by operating the lever 41 to raise the valve pistons 36 and 39. After a short initial movement, the valve seal rides above the lower edge of the discharge outlet opening so as to place the port 44 in communication with atmosphere through the piston neck 45 and the outlet 38 to discharge pressurised gas from the head space and reduces its pressure to atmospheric. This stage is shown in FIG. 6, from which it is seen that the inlet valve 36 is still in a closed position. Continued movement of the lever 41 raises the valve pistons to the positions shown in FIG. 7 in which both valves are fully open to permit fresh water from the header tank to enter through the bottom inlet and discharge the overlying aerated water through the outlet 38 into a glass or other receptacle placed under the outlet nozzle. When the desired amount of aerated liquid (up to a maximum amount corresponding with the capacity of the pressure chamber) has been discharged, the operating lever is returned to its initial position, shown in FIG. 5, to complete the operating cycle.

It will be appreciated that venting of the head space is effected without any accompanying liquid discharge since the venting port 44 is positioned at the top of the head space, in which no liquid is present. This facility is also provided in a simple and inexpensive manner by virtue of the fact that the seal for the varying arrangement is the outlet seal and the necessary operating movement is provided without the need for additional linkages or operating mechanism.

In the illustrated apparatus, it has been found that an adequate seal is obtained between the lower portion of the piston 39 and the valve bore 37, without an additional sealing ring in this region. Provided a reasonably good sliding fit is provided in this region and a small liquid head is maintained, the port 44 is adequately sealed by the piston during the discharge operation. However, if a larger liquid head were to be employed, an O-ring seal could be fitted to the lower part of the plunger.

Venting of the head space is effected very quickly and will usually be completed without difficulty as long as the plungers are raised at a reasonable speed. However, to prevent abuse of the apparatus and ensure complete venting, we prefer to guide the lever 41 in a gate 46 (FIG. 1) including an interruption which corresponds with the venting position of the piston 39 and which causes the user to move the lever laterally before movement of the lever to the discharging position can be continued.

The tank of the apparatus is conveniently dimensioned so as to permit the pressure vessel to be filled and its contents carbonated and discharged, six or seven times.

I claim:

1. An apparatus for carbonating water, comprising a pressure vessel and a header tank containing a quantity of fresh water, said vessel having a bottom inlet and an outlet in an upper region thereof, a water feed tube connecting said tank into said vessel, discharge means communicating with said outlet through which carbonated water is discharged from said vessel, an injection nozzle extending into said vessel for admitting $CO_2$ from a pressurized $CO_2$ supply into said vessel, said vessel defining a head space in said upper region, said inlet and said outlet being respectively defined by inlet and outlet axial valve bores, spaced inlet and outlet valve pistons being rigidly interconnected to form a unitary plunger, said pistons respectively having opposed equal pressure surfaces facing one another and being directly exposed to the interior of said vessel whereby said plunger is substantially pressure balanced, and said pistons respectively being disposed for sliding movement in said bores for opening and closing said inlet and said outlet, pressure release valve means at said upper region for connecting said head space to atmosphere, means for admitting $CO_2$ under pressure to the interior of said vessel and manually operable means for first releasing pressure from said head space by operating said release valve means and then discharging carbonated water through said discharge means by opening said inlet and outlet pistons in unison.

2. The apparatus according to claim 1, wherein an axial extension is provided on said plunger and projects outwardly of said vessel, and an operating member being coupled with said extension and defining said means for opening said inlet and outlet pistons in unison.

3. The apparatus according to claim 1, wherein a movable operating member is coupled with said plunger and gate means are provided on the apparatus for guiding said member, said gate means being adapted to interrupt movement of said member from an end position at which said inlet and said outlet are closed to an opposite end position at which said inlet and said outlet are open.

4. The apparatus according to claim 1, wherein said header tank is mounted on the apparatus for removal as a unit and has an outlet valve capable of being opened when said header tank is mounted on the apparatus, but which closed in response to removal of said tank.

* * * * *